US006450852B1

(12) United States Patent
Arredondo

(10) Patent No.: US 6,450,852 B1
(45) Date of Patent: Sep. 17, 2002

(54) GLIDER TOY

(76) Inventor: Erasmo Arredondo, 131 Rigney St., Brentwood, NY (US) 11717

( * ) Notice: Subject to any disclaimer, the term of this patent is extended or adjusted under 35 U.S.C. 154(b) by 0 days.

(21) Appl. No.: 10/043,521

(22) Filed: Jan. 11, 2002

(51) Int. Cl.[7] ..... A63H 27/00

(52) U.S. Cl. ..... 446/61; 244/154; 446/67; 446/68

(58) Field of Search ..... 446/61, 67, 66, 446/68; 244/12.2, 23 C, 154, 153 R; 473/613

(56) References Cited

U.S. PATENT DOCUMENTS

| | | | | |
|---|---|---|---|---|
| D194,401 | S | 1/1963 | Tombros | |
| 3,547,384 | A | 12/1970 | Clark | |
| 4,033,070 | A | * 7/1977 | Strongin et al. | 446/68 |
| 4,248,007 | A | * 2/1981 | Gamburd | 244/16 |
| 4,512,690 | A | 4/1985 | Johnson | |
| 4,997,401 | A | 3/1991 | Rose et al. | |
| 5,360,028 | A | * 11/1994 | Jasin | 135/119 |
| 5,669,803 | A | * 9/1997 | Sweed | 244/154 |
| 5,971,321 | A | * 10/1999 | Libengood | 244/23 B |
| 6,073,881 | A | * 6/2000 | Chen | 244/12.2 |
| 6,113,029 | A | * 9/2000 | Salinas | 244/12.6 |

FOREIGN PATENT DOCUMENTS

| | | | |
|---|---|---|---|
| GB | 2184077 A | * | 6/1987 |

* cited by examiner

*Primary Examiner*—Jacob K. Ackun
*Assistant Examiner*—Bena B. Miller

(57) ABSTRACT

A glider toy for entertainment purposes. The glider toy includes a housing that includes an upper plate section and a lower plate section. The upper plate section has a substantially circular shape. The lower plate section is generally crescent-shaped. A bulbous member is attached to the top side of the upper plate section. A nose piece is fixedly coupled to the housing and positioned adjacent to the front portion of the lower plate section. A tail member is attached to the top side of the upper plate section and is positioned adjacent to a rear edge of the upper plate section. A pair of fin members is attached to and extends away from opposing sides of the tail member. A pair of support members is attached to and extends away from the bottom side of the lower plate section. All of the aforementioned parts comprise a resilient closed cell material.

16 Claims, 2 Drawing Sheets

GLIDER TOY

BACKGROUND OF THE INVENTION

1. Field of the Invention

The present invention relates to glider toys and more particularly pertains to a new glider toy for entertainment purposes.

2. Description of the Prior Art

The use of glider toys is known in the prior art. U.S. Pat. No. 3,547,384 describes an air foil flying device with multiple-stage lift areas. Another type of glider toys is U.S. Pat. No. 5,669,803 having a body member, a wing member having a length greater than a width of the body member, and a weight member secured to the body member forward of the wing member.

While these devices fulfill their respective, particular objectives and requirements, the need remains for a device has unique aerodynamic qualities for better performance.

SUMMARY OF THE INVENTION

The present invention meets the needs presented above by incorporating a crescent-shaped wing section and a dihedral raised tail assembly.

Still yet another object of the present invention is to provide a new glider toy that flies better than previous designs.

To this end, the present invention generally comprises a housing that includes an upper plate section and a lower plate section. The upper plate section has a substantially circular shape. The lower plate section is generally crescent-shaped. A bulbous member is attached to the top side of the upper plate section. A nose piece is fixedly coupled to the housing and positioned adjacent to the front portion of the lower plate section. A tail member is attached to the top side of the upper plate section and is positioned adjacent to a rear edge of the upper plate section. A pair of fin members is attached to and extends away from opposing sides of the tail member. A pair of support members is attached to and extends away from the bottom side of the lower plate section. All of the aforementioned parts comprise a resilient closed cell material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
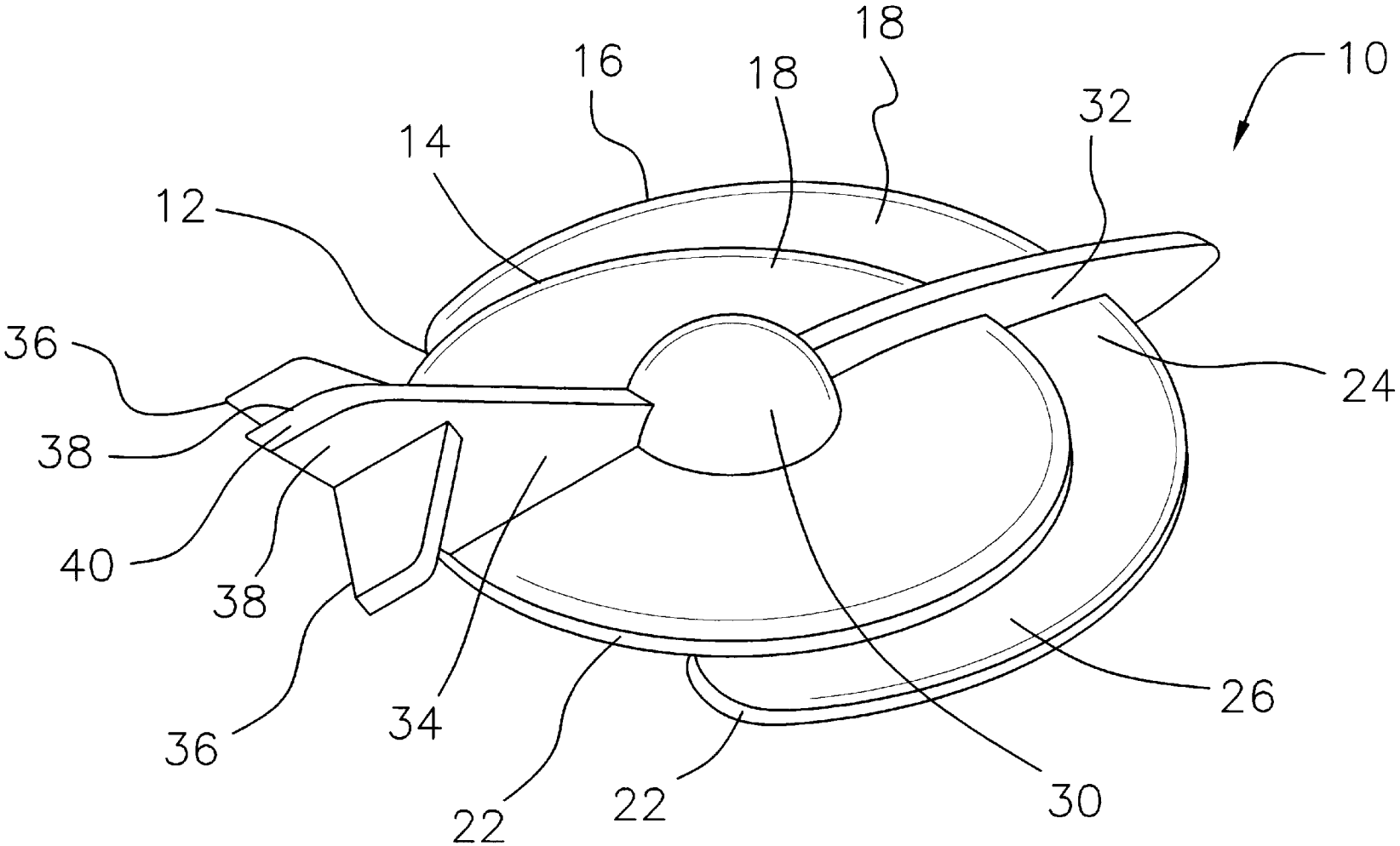
FIG. 1 is a schematic perspective top view of a new glider toy according to the present invention.
Figure 2:
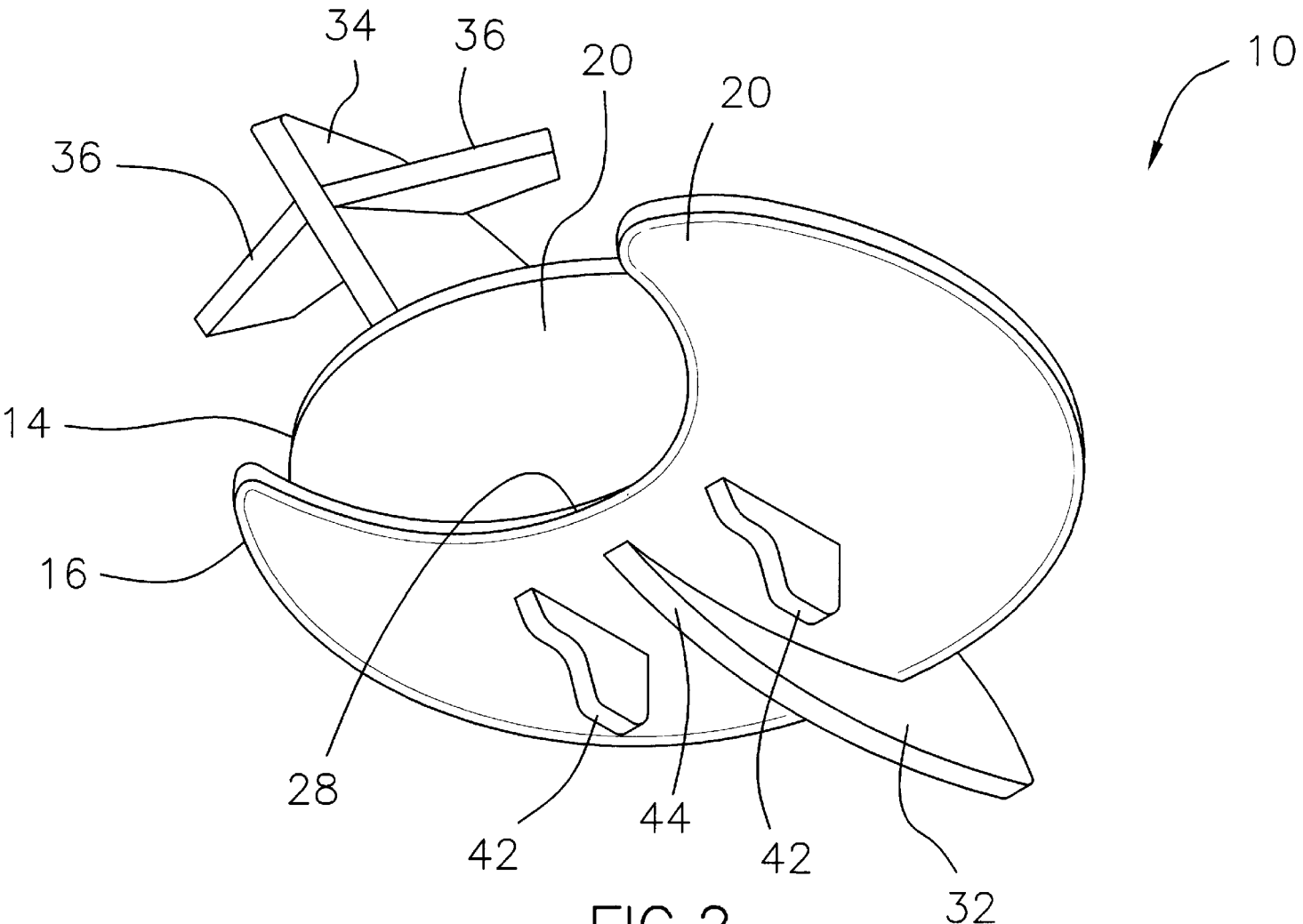
FIG. 2 is a schematic perspective bottom view of the present invention.

With reference now to the drawings, and in particular to FIGS. 1 and 2 thereof, a new glider toy embodying the principles and concepts of the present invention and generally designated by the reference numeral 10 will be described.

As best illustrated in FIGS. 1 and 2, the glider toy 10 generally comprises a housing 12 that includes an upper plate section 14 and a lower plate section 16. Each of the plate sections 14, 16 has a top side 18, a bottom side 20, and an outer edge 22. The bottom side 20 of the upper plate section 14 is fixedly coupled to the top side 18 of the lower plate section 16.

The upper plate section 14 has a substantially circular shape, while the lower plate section 16 is generally crescent-shaped. The lower plate section 16 is generally larger than the upper plate section 14 such that a front portion 24 and side portions 26 of the lower plate section 16 extend outward from the outer edge 22 of the upper plate section 14. The lower plate section 16 is oriented such that an inward arcuate portion 28 formed by the crescent shape opposes the front portion 24. The lower plate section 16 defines a wing portion of an aircraft. The housing 12 comprises a resilient closed cell material.

A bulbous member 30 is attached to and extends upwardly from the top side 18 of the upper plate section 14. The bulbous member 30 is centrally positioned on the upper plate section 14 and is dome-shaped. The bulbous member 30 comprises a resilient closed cell material.

A nose piece 32 is fixedly coupled to the housing 12 and positioned adjacent to the front portion 24 of the lower plate section 16. The nose piece 32 is wedge-shaped such that each of the upper and lower plate sections 14, 16 extend into the wedge. The nose piece 32 is oriented perpendicular to a plane of each of the plate sections 14, 16. The nose piece 32 comprises a resilient closed cell material.

A tail member 34 is attached to the top side 18 of the upper plate section 14 and is positioned between the bulbous member 30 and the outer edge 22 of the upper plate section 14. The tail member 34 extends outward away from the top side 18 of the upper plate section 14 and is angled rearwardly. The tail member 34 is co-planar of the nose piece 32. The tail member 34 defines a vertical stabilizer portion of the airplane and comprises a resilient closed cell material.

A pair of fin members 36 is attached to and extends away from opposing sides 38 of the tail member 34. Each of the fin members 36 is positioned between a top edge 40 of the tail member 34 and the top side 18 of the upper plate section 14. A plane of each of the fin members 36 is substantially perpendicular to a plane of the tail member 34. The fin members 36 define a horizontal stabilizer portion of the airplane and comprise a resilient closed cell material.

A pair of support members 42 is attached to and extends away from the bottom side 20 of the lower plate section 16. Each of the support members 42 are located on opposing sides 38 of a rear bottom portion 44 of the nose piece 32 and positioned adjacent to the arcuate portion 28 of the lower plate section 16. The support members 42 comprise a resilient closed cell material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glider toy for entertainment purposes, said glider toy comprising:

a housing including an upper plate section and a lower plate section, each of said plate sections having a top side, a bottom side, and an outer edge, said lower plate section defining a wing portion of an airplane;

a bulbous member being attached to and extending upwardly from said top side of said upper plate section;

a nose piece being fixedly coupled to said housing and positioned adjacent to said front portion of said lower plate section;

a tail member being attached to said top side of said upper plate section and being positioned between said bulbous member and said outer edge of said upper plate section, said tail member defining a vertical stabilizer portion of the airplane;

a pair of fin members being attached to and extending away from opposing sides of said tail member, said fin members defining a horizontal stabilizer portion of the airplane; and a pair of support members being attached to and extending away from said bottom side of said lower plate section.

2. The glider toy as set forth in claim 1, further comprising said bottom side of said upper plate section being fixedly coupled to said top side of said lower plate section.

3. The glider toy as set forth in claim 1, further comprising said upper plate section having a substantially circular shape, said lower plate section being generally crescent-shaped, said lower plate section being generally larger than said upper plate section such that a front portion and side portions of said lower plate section extend outward from said outer edge of said upper plate section.

4. The glider toy as set forth in claim 3, further comprising said lower plate section being oriented such that an inward arcuate portion formed by said crescent shape opposes said front portion.

5. The glider toy as set forth in claim 1, further comprising said housing comprising a resilient closed cell material.

6. The glider toy as set forth in claim 1, further comprising said bulbous member being centrally positioned on said upper plate section, said bulbous member being dome-shaped.

7. The glider toy as set forth in claim 1, further comprising said bulbous member comprising a resilient closed cell material.

8. The glider toy as set forth in claim 1, further comprising said nose piece being wedge-shaped such that each of said upper and lower plate sections extend into said wedge, said nose piece being oriented perpendicular to a plane of each of said plate sections.

9. The glider toy as set forth in claim 1, further comprising said nose piece comprising a resilient closed cell material.

10. The glider toy as set forth in claim 1, further comprising said tail member extending outwardly away from said top side of said upper plate section and being angled rearwardly, said tail member being co-planar of said nose piece.

11. The glider toy as set forth in claim 1, further comprising said tail member comprising a resilient closed cell material.

12. The glider toy as set forth in claim 1, further comprising each of said fin members being positioned between a top edge of said tail member and said top side of said upper plate section, a plane of each of said fin members being substantially perpendicular to a plane of said tail member.

13. The glider toy as set forth in claim 1, further comprising said fin members comprising a resilient closed cell material.

14. The glider toy as set forth in claim 4, further comprising each of said support members being located on opposing sides of a rear bottom portion of said nose piece and positioned adjacent to said arcuate portion of said lower plate section.

15. The glider toy as set forth in claim 1, further comprising said support members comprising a resilient closed cell material.

16. A glider toy for entertainment purposes, said glider toy comprising:

a housing including an upper plate section and a lower plate section, each of said plate sections having a top side, a bottom side, and an outer edge, said bottom side of said upper plate section being fixedly coupled to said top side of said lower plate section, said upper plate section having a substantially circular shape, said lower plate section being generally crescent-shaped, said lower plate section being generally larger than said upper plate section such that a front portion and side portions of said lower plate section extend outward from said outer edge of said upper plate section, said lower plate section being oriented such that an inward arcuate portion formed by said crescent shape opposes said front portion, said lower plate section defining a wing portion of an aircraft, said housing comprising a resilient closed cell material;

a bulbous member being attached to and extending upwardly from said top side of said upper plate section, said bulbous member being centrally positioned on said upper plate section, said bulbous member being domeshaped, said bulbous member comprising a resilient closed cell material;

a nose piece being fixedly coupled to said housing and positioned adjacent to said front portion of said lower plate section, said nose piece being wedge-shaped such that each of said upper and lower plate sections extend into said wedge, said nose piece being oriented perpendicular to a plane of each of said plate sections, said nose piece comprising a resilient closed cell material;

a tail member being attached to said top side of said upper plate section and being positioned between said bulbous member and said outer edge of said upper plate section, said tail member extending outwardly away from said top side of said upper plate section and being angled rearwardly, said tail member being co-planar of said nose piece, said tail member defining a vertical stabilizer portion of the airplane said tail member comprising a resilient closed cell material;

a pair of fin members being attached to and extending away from opposing sides of said tail member, each of said fin members being positioned between a top edge of said tail member and said top side of said upper plate section, a plane of each of said fin members being substantially perpendicular to a plane of said tail member, said fin members defining a horizontal stabilizer portion of the airplane, said fin members comprising a resilient closed cell material;

a pair of support members being attached to and extending away from said bottom side of said lower plate section, each of said support members being located on opposing sides of a rear bottom portion of said nose piece and positioned adjacent to said arcuate portion of said lower plate section, said support members comprising a resilient closed cell material.

* * * * *